US007785160B2

(12) United States Patent
Shimizu

(10) Patent No.: US 7,785,160 B2
(45) Date of Patent: Aug. 31, 2010

(54) TERMINAL FITTING

(75) Inventor: Tooru Shimizu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/417,270

(22) Filed: Apr. 2, 2009

(65) Prior Publication Data

US 2009/0253314 A1 Oct. 8, 2009

(30) Foreign Application Priority Data

Apr. 4, 2008 (JP) ..... 2008-098234

(51) Int. Cl.
*H01R 11/22* (2006.01)

(52) U.S. Cl. ..... 439/852; 439/595

(58) Field of Classification Search ..... 439/249, 439/252, 595, 752, 843, 845, 849–852
See application file for complete search history.

(56) References Cited

U.S. PATENT DOCUMENTS

| | | | | |
|---|---|---|---|---|
| 5,800,220 | A * | 9/1998 | Feeny et al. | 439/849 |
| 6,364,722 | B1 * | 4/2002 | Yamamoto | 439/850 |
| 6,736,684 | B2 * | 5/2004 | Ishiyama | 439/852 |
| 7,156,704 | B2 * | 1/2007 | Shimizu | 439/852 |
| 7,229,328 | B2 * | 6/2007 | Sawada et al. | 439/852 |
| 7,229,329 | B2 * | 6/2007 | Yamashita et al. | 439/852 |
| 7,255,614 | B1 * | 8/2007 | Irish et al. | 439/849 |
| 7,556,541 | B2 * | 7/2009 | Tyler | 439/843 |
| 2002/0055297 | A1 * | 5/2002 | Feeny, Jr. | 439/453 |
| 2003/0049975 | A1 | 3/2003 | Tsuji et al. | |
| 2003/0096533 | A1 | 5/2003 | Kojima et al. | |
| 2003/0096538 | A1 | 5/2003 | Kojima et al. | |
| 2006/0068650 | A1 | 3/2006 | Shimizu | |
| 2007/0149068 | A1 | 6/2007 | Shimizu | |

FOREIGN PATENT DOCUMENTS

JP 2004-220964 8/2004

* cited by examiner

*Primary Examiner*—Thanh-Tam T Le
(74) *Attorney, Agent, or Firm*—Gerald E. Hespos; Michael J. Porco

(57) ABSTRACT

A terminal fitting (T) is formed by bending a metal plate material (Ta) punched out into a specified shape, and a facing surface (15S) of a resilient contact piece (15) facing a male tab (M) and a facing surface (20S) of a receiving plate (20) facing the male tab (M) are partially recessed within the range of the thickness of the metal plate material (Ta). Thus, thick portions (28A, 29A, 28B) and (29B) and thin portions (27A, 27B) are arranged alternately in a width direction orthogonal to an inserting direction of the male tab (M). Parts of the male tab (M) are held in contact with the thick portions (28A, 29A, 28B) and (29B) in the width direction.

13 Claims, 10 Drawing Sheets

TERMINAL FITTING

BACKGROUND OF THE INVENTION

1. Field of the Invention

The invention relates to a terminal fitting.

2. Description of the Related Art

Japanese Unexamined Patent Publication No. 2004-220964 discloses a terminal fitting formed by bending a metal plate material that has been punched out into a specified shape. The terminal fitting includes a rectangular tube and a resilient contact piece is accommodated in the rectangular tube. A male tab inserted into the rectangular tube is squeezed resiliently between a receiving plate of the rectangular tube and the resilient contact piece to achieve electrically conductive contact.

The resilient contact piece is hammered to form a contact portion with a small contact area for contacting the male tab. A resilient contact piece without a small contact portion is thought to define a wide contact area and a small electrical contact resistance. However, metal surfaces are rough when seen microscopically. Thus, the metals are in contact at a multitude of points in a low contact pressure state. These contact points have a high possibility of being separated if the resilient contact piece and the male tab displace slightly. Therefore, such a contact mode is unstable and there cannot be a high expectation for a reduction of contact resistance.

In contrast, contact pressure per unit area increases if an apparent contact area is made smaller by forming the contact portion. Therefore, the metal surfaces are deformed to conform to each other, and the area of the surface contact increases when seen microscopically. The contact state is maintained in the surface contact area even if the resilient contact piece and the male tab are displaced slightly from each other. As a result, a contact state in a wide area is maintained stably and contact resistance is reduced.

The contact portion of the above-described known terminal fitting is formed by hammering a part of the resilient contact piece to project from the surface of the resilient contact piece. Thus, the terminal fitting becomes bulkier by a projecting distance of the contact portion in a direction in which the male tab is squeezed between the resilient contact piece and the receiving plate.

The invention was developed in view of the above situation and an object thereof is to reduce the height of a terminal fitting.

SUMMARY OF THE INVENTION

The invention relates to a terminal fitting formed by bending, folding and/or embossing a conductive plate material having a specified shape. The terminal fitting includes a tube and a resilient contact piece at least partly accommodated in the tube. A male tab can be inserted into the tube and is squeezed resiliently between a receiving plate of the tube and the resilient contact piece to achieve electrically conductive contact. At least one of a facing surface of the resilient contact piece facing the male tab and a facing surface of the receiving plate facing the male tab is notched or recessed within the range of the thickness of the conductive plate material. Thus, thick and thin portions are arranged alternately in a width direction that is orthogonal to an inserting direction of the male tab. Parts of the male tab in the width direction are held partly in contact with the thick portions. Thus, a contact area is small and contact resistance is low. Additionally, the notching or recessing within the range of the thickness of the conductive plate material shortens the height in a male tab squeezing direction as compared with the case where a contact point is a projection.

Thick portions preferably are arranged in a widthwise intermediate position and at least at one of the opposite widthwise sides. The thick portion in the widthwise intermediate position and the at least one thick portion at least at one of the opposite widthwise ends preferably have the same height.

A male tab that initially is held in contact with the thick portion in the widthwise center could be displaced in the width direction. However, the displaced male tab will contact one of the thick portions at the opposite widthwise sides to maintain a stable contact state.

The surface of the resilient contact piece facing the male tab and the surface of the receiving plate facing the male tab preferably are formed with two recesses spaced apart in the width direction. The recesses preferably correspond to the opposite lateral edges of the male tab in the width direction.

The recesses of the resilient contact piece and/or those of the receiving plate preferably are formed in the thin portions.

Opposite left and right edges of the male tab will enter the recesses without touching the surfaces of the thick portions if the male tab is inclined to the left or right when the male tab is squeezed resiliently between the resilient contact piece and the receiving plate. Accordingly, there is no likelihood that the surface of the resilient contact piece facing the male tab and the surface of the receiving plate facing the male tab will be damaged by the opposite left and right edges of the male tab.

The thick portion in the widthwise intermediate position preferably has a constant height in the width direction. Thus, the thick portion in the widthwise center and the male tab are continuously in line contact or in surface contact in the width direction. Therefore, the male tab is unlikely to incline in a manner that would bring the opposite left and right edges of the male tab closer to the resilient contact piece or the receiving plate.

Horizontal cross-sectional shapes of the recesses orthogonal to forward and backward directions preferably are arcuate. Formation areas of the recesses in forward and backward directions preferably extend from a front end of the resilient contact piece to a position slightly before a support thereof.

A top part of a center thick portion preferably defines a main contact point with the male tab and top parts of the side thick portion preferably define auxiliary contact points. One of the main contact point and the auxiliary contact points preferably are continuous in the width direction, so that these contact points are held in line contact with the male tab in the width direction.

A rear end of the resilient contact piece may be embossed out to form at least one support held in contact with an inner surface of a base plate of the tube and supports resilient deformation of the resilient contact piece. The support preferably extends substantially straight in a width direction and/or has an arcuate shape in a cross section normal to the width direction.

These and other objects, features and advantages of the invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
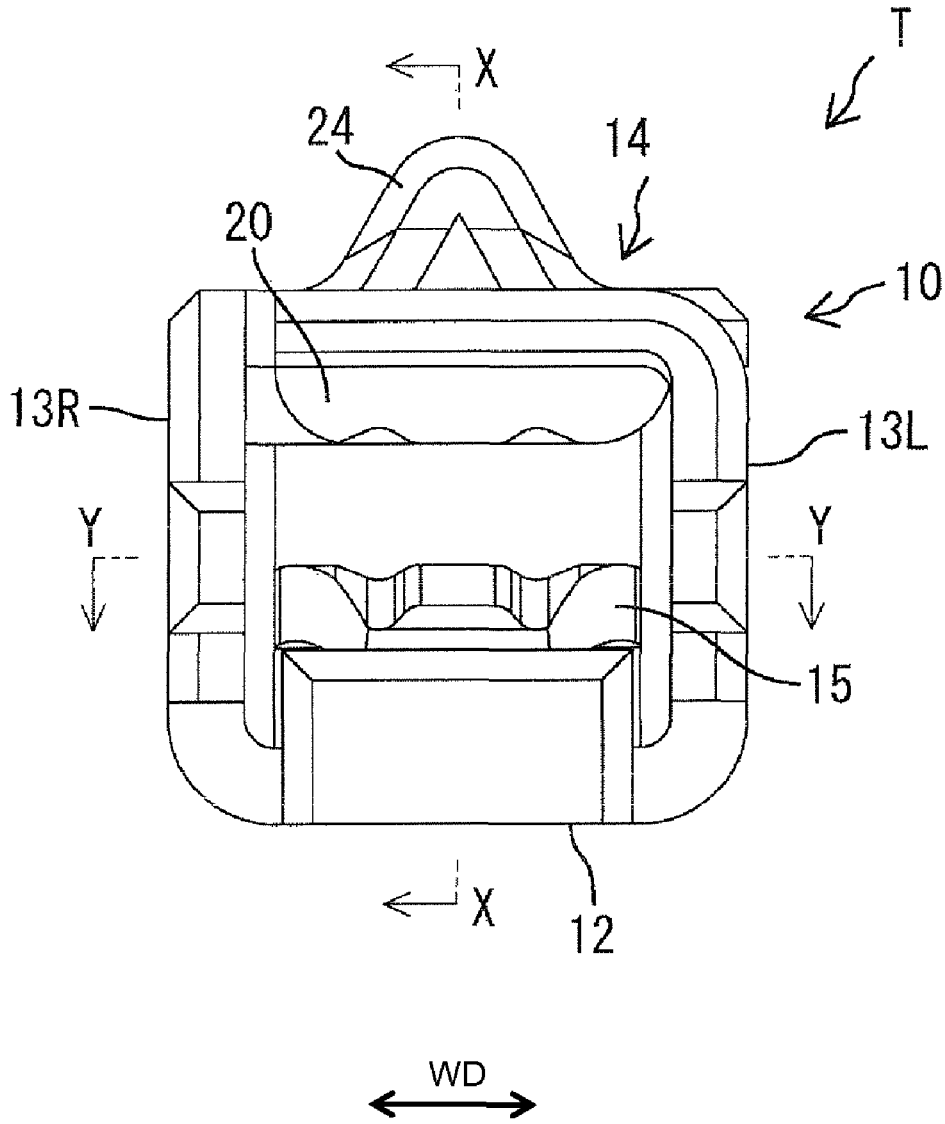
FIG. 1 is a front view of a terminal fitting according to one embodiment of the invention.
Figure 2:
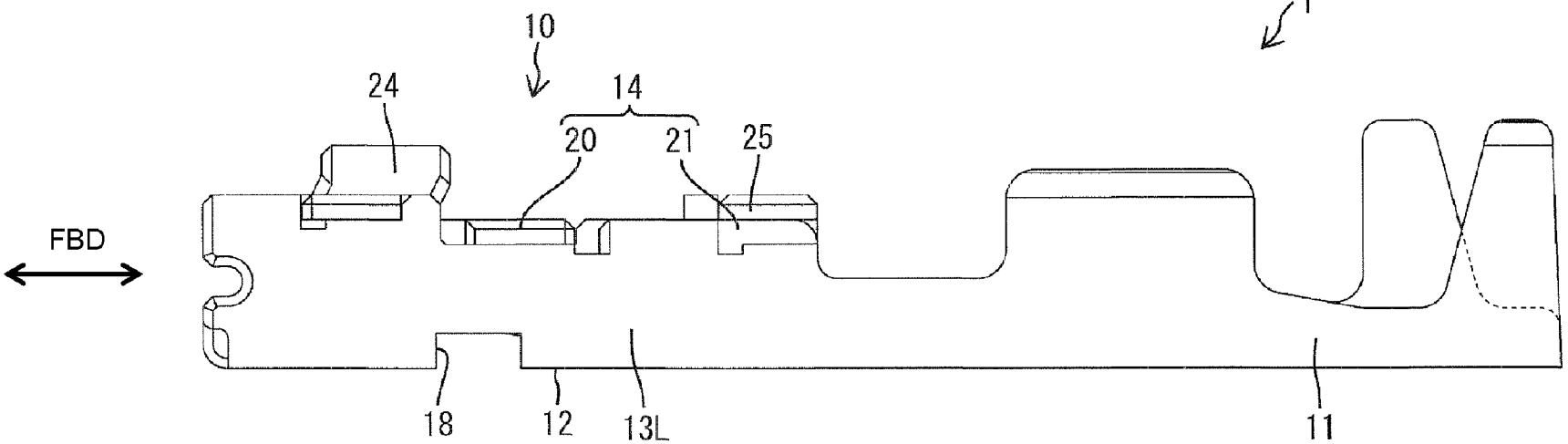
FIG. 2 is a side view of the terminal fitting.
Figure 3:
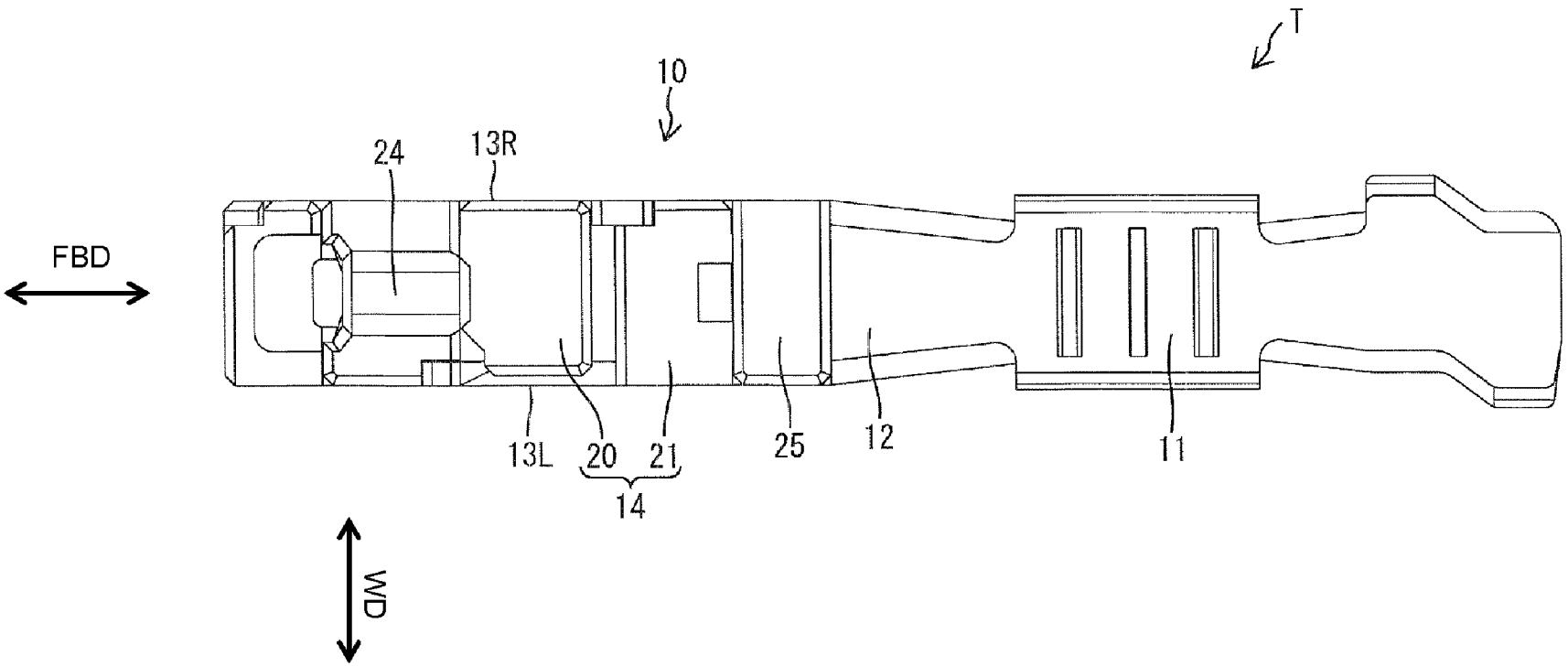
FIG. 3 is a plan view of the terminal fitting.

A female terminal fitting in accordance with the invention is identified by the letter T in FIGS. 1 to 11. The terminal fitting T is formed by bending, folding, embossing, stamping and/or cutting a conductive metal plate material Ta that has been punched or cut out into the shape shown in FIG. 11. The metal plate material Ta is entirely uniform in thickness and is bent along bending lines shown in broken line in FIG. 11.

The terminal fitting T is long and narrow in forward and backward directions and has opposite front and rear ends. A substantially rectangular tube 10 is formed at the front end and a wire crimping portion 11 is formed at the rear end. The rectangular tube 10 includes a bottom plate 12 that is long and narrow in forward and backward directions FBD. Left and right side plates 13L, 13R project up at substantially right angles from the opposite left and right edges of the bottom plate 12 and an upper plate 14 extends from the upper end edge of the left side plate 13L to extent substantially parallel to the bottom plate 12.

A resilient contact piece 15 is accommodated in the rectangular tube 10, and a male tab M can be inserted into the rectangular tube 10 from the front. Thus, the male tab M is squeezed vertically by a resilient force of the resilient contact piece 15 between an upper surface 15S of the resilient contact piece 15 and a lower surface 20S of a receiving plate 20 of the upper plate 14 so that the male tab M and the terminal fitting T achieve electrically conductive connection. The male tab M is substantially rectangular in a horizontal cross section normal to an inserting direction. A wire (not shown) is connected conductively with the wire crimping portion 11 by known crimping means.

A substantially rectangular first window 16 penetrates a front end portion of the bottom plate 12 of the rectangular tube 10. A tapered notch 17 is formed behind and adjacent to the first window 16 so that the upper surface of the bottom plate 12 slopes down toward the front (see e.g. FIG. 4). A second window 18 penetrates the bottom plate 12 in a substantially central part with respect to forward and backward directions FBD. The second window 18 extends over substantially the entire width of the bottom plate 12 and opens into the bottom ends of the left and right side plates 13L, 13R. The second window 18 is to be engaged with a locking lance (not shown) that extends substantially along a bottom wall of a cavity (not shown) of a connector housing when the terminal fitting T is inserted to a proper position in the cavity. Thus, the locking lance functions as retaining means for retaining the terminal fitting T. A receiving recess 19 is formed in a rectangular area of the upper surface of the bottom plate 12 behind and adjacent to the second window 18.

The receiving panel 20 takes up more than half of an area (preferably substantially ⅔ area) at a front end of the upper plate 14. The receiving panel 20 is connected with the left side plate 13L only at its front end and cantilevers backward. A supporting panel 21 extends from the left side 13L independently from the receiving panel 20 and takes up less than half the area (preferably a substantially ⅓ area) at a rear end. A substantially frame-shaped coupling panel 22 extends down at a substantially right angle from the rear end edge of the supporting panel 21, and the resilient contact piece 15 cantilevers forward from the bottom end edge of the coupling panel 22.

When seen sideways (see e.g. FIG. 4), the resilient contact piece 15 is curved so that the opposite front and rear ends are lowest and an intermediate position in forward and backward directions FBD is highest or more inward. The rear end of the resilient contact piece 15 is embossed down and out to form a support 23. The support 23 extends substantially straight in a width direction WD and has a substantially arcuate shape in a cross section normal to the width direction WD. The supporting portion 23 is held in contact with the upper surface of the receiving portion 19 and functions as a supporting point of resilient deformation of the resilient contact piece 15.

A bulge 24 extends from a position near the front end of the upper end edge of the right side plate 13R. The bulge 24 is bent to have a mountain shape when seen from the front (see e.g. FIG. 1) and functions as inverted insertion preventing means for preventing the terminal fitting T from being inserted in an improper posture. This bulge 24 is held in contact with and at least partly covers the opposite left and right ends of the upper surface of the receiving plate 20. Thus, a substantially triangular dead space is formed between the upper surface of the receiving plate 20 and the lower surface of the bulge 24. Further, a pressing plate 25 extends from the rear end of the upper end edge of the right side plate 13L. The pressing plate 25 is held in contact with the upper surface of the supporting plate 21 and presses the supporting plate 21 from above to prevent an upward displacement of the supporting plate 21, i.e. an upward movement of the resilient contact piece 15.

Left and right first recesses 26A are formed in the upper surface 15S of the resilient contact piece 15 extend in forward and backward directions FBD. The first recesses 26A preferably are not formed by hammering or press-forming the resilient contact piece 15 from the upper side toward the lower side, but rather preferably are formed by grooves in the upper surface 15S within the range of the thickness of the resilient contact piece 15 (i.e. within the range of the thickness of the metal plate material Ta). Horizontal cross-sectional shapes of the first recesses 26A orthogonal to forward and backward directions FBD preferably are arcuate. The first recesses 26A are symmetrical with respect to the width direction WD (i.e. substantially normal to the inserting direction). Formation areas of the first recesses 26A in forward and backward directions FBD extend from the front end of the resilient contact piece 15 to a position slightly before the supporting panel 23, and the first recesses 26A are continuous in forward and backward directions FBD in these formation ranges.

Figure 6:
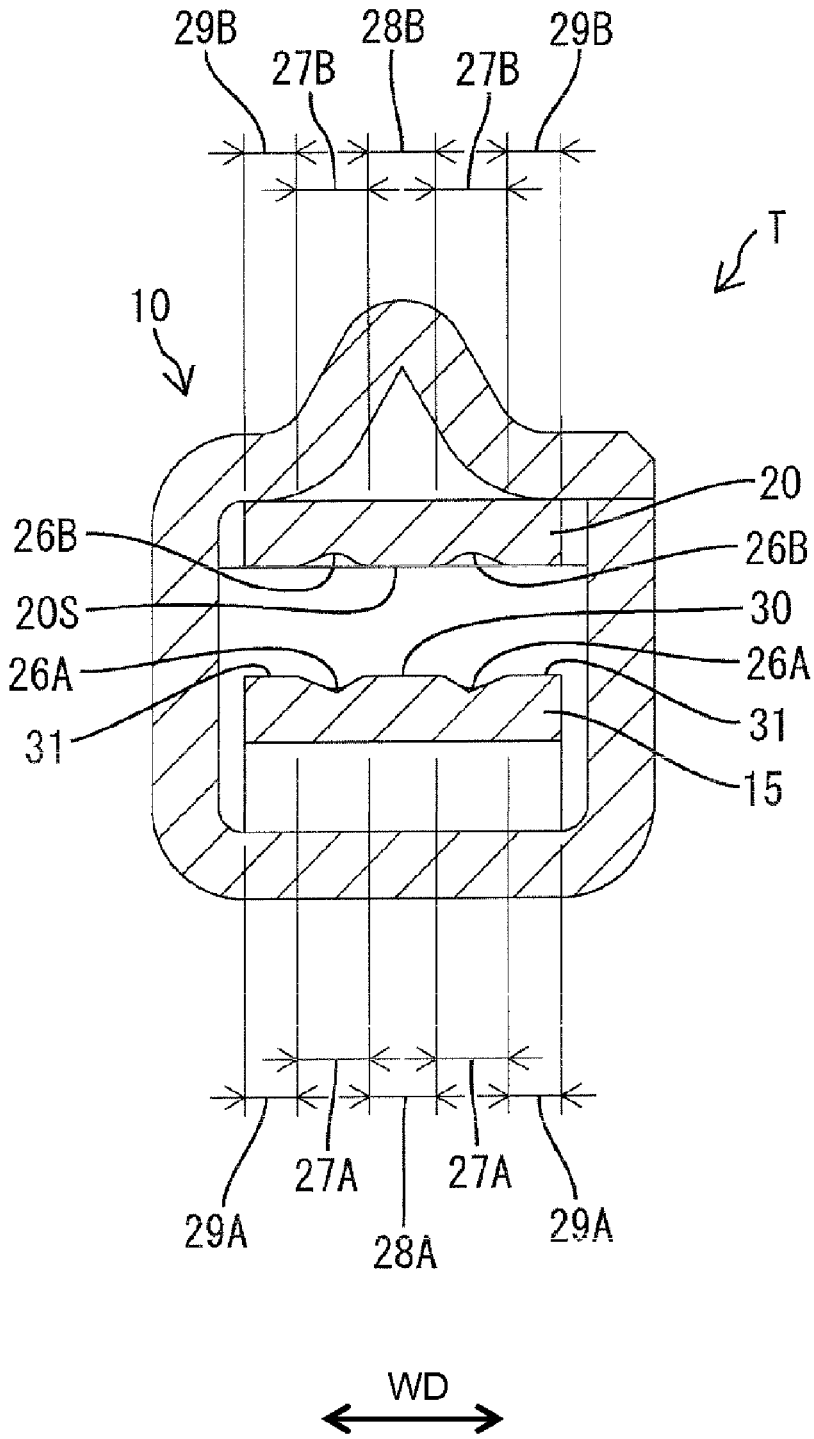
FIG. 6 is a section along Z-Z of FIG. 4.

The resilient contact piece 15 includes left and right first thin portions 27A that correspond to the formation areas of the first recesses 26A in the width direction WD, as shown in FIG. 6. A middle first thick portion 28A is defined at a widthwise middle position corresponding to an area between the first recesses 26A. Left and right side first thick portions 29A at the opposite widthwise sides and correspond to areas extending from the left and right first recesses 26A to the outer lateral edges of the resilient contact piece 15. Specifically, the first thin portions 27A are between the side first thickened portion 28A and the side first thick portions 29A. In other words, three first thick portions 28A, 29A and two first thin portions 27A are arranged alternately in the width direction WD.

Figure 4:
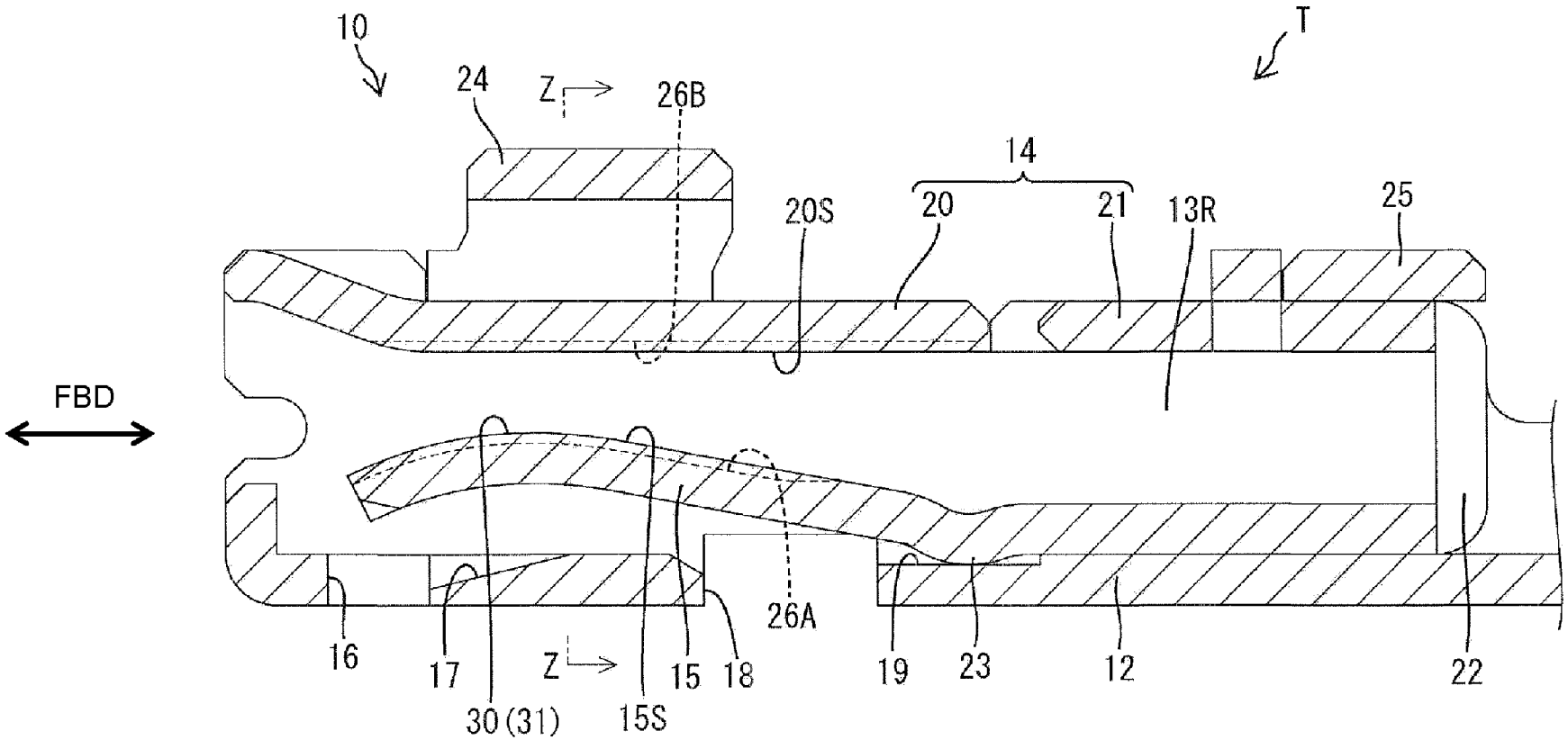
FIG. 4 is a section along X-X of FIG. 1.
Figure 5:
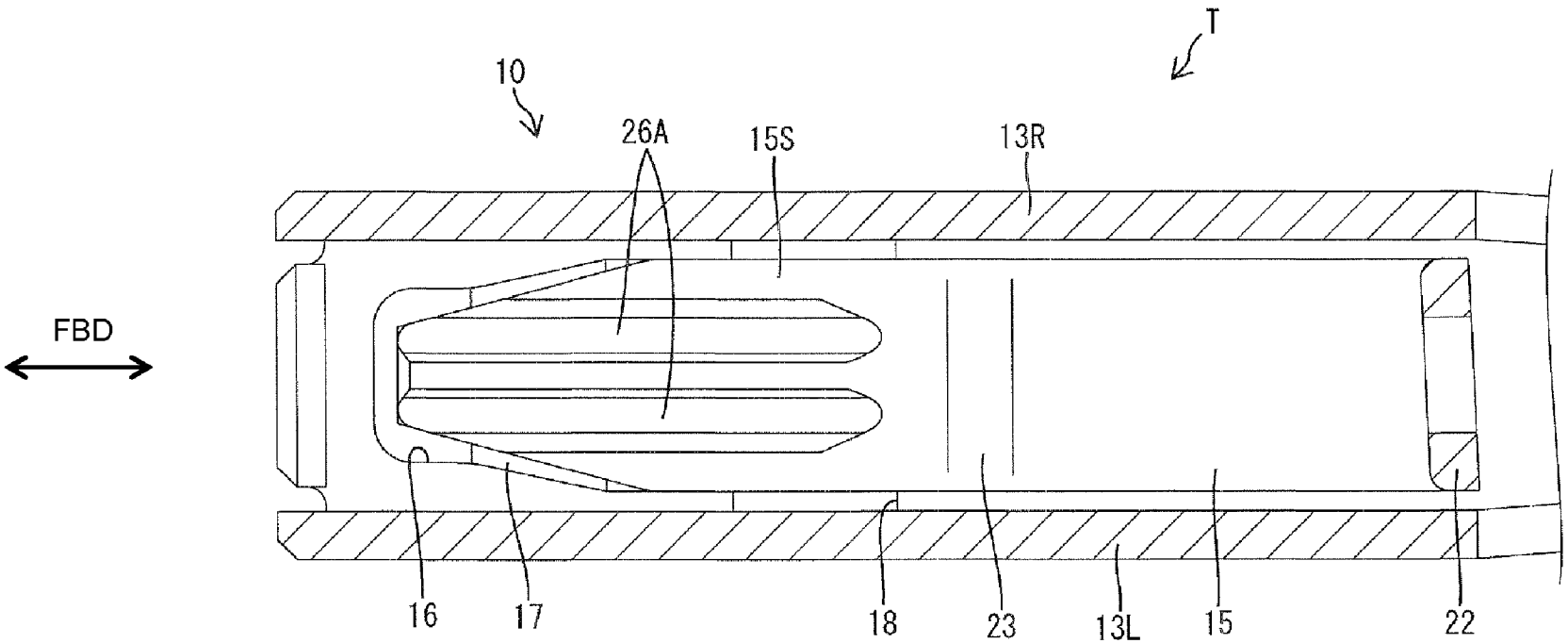
FIG. 5 is a section along Y-Y of FIG. 1.

The upper surfaces of the middle first thick portion 28A and the side first thick portions 29A have tops with a largest height at a position close to the front end of the resilient contact piece 15 (see FIG. 4). As shown in FIG. 6, the top of the middle first thick portion 28A defines a main contact point 30 and the tops of the side first thick portions 29A define auxiliary contact points 31. The main contact point 30 of the middle first thick portion 28A and the auxiliary contact points 31 of the side first thick portions 29A are at substantially the same height. The main contact point 30 of the middle first thick portion 28A and the auxiliary contact points 31 of the side first thick portions 29A are continuous in the width direction WD and are held continuously in line contact with the lower surface of the male tab M in the width direction WD. The first facing surface 15S of the resilient contact piece 15 is substantially symmetrical with respect to the width direction WD.

Left and right second recesses 26B are formed in the second facing surface 20S of the receiving plate 20 and extend substantially in forward and backward directions FBD. The second recesses 26B are not formed by hammering or pressing the receiving plate 20 from the inner side toward the outer side (upper side), but rather preferably are formed by grooves in the second facing surface 20S within the range of the thickness of the receiving plate 20 (i.e. within the range of the thickness of the metal plate material Ta). Horizontal cross-sectional shapes of the second recesses 26B orthogonal to forward and backward directions FBD preferably are arcuate. The second recesses 26B preferably are substantially symmetrical with respect to the width direction WD (i.e. lateral direction). Additionally, the second recesses 26B preferably extend continuously in forward and backward directions FBD from a position slightly behind the front end of the receiving plate 20 to the rear end of the receiving plate 20.

Left and right second thin portions 27B are formed in the receiving plate 20 at positions in the width direction WD corresponding to the formation areas of the second recesses 26B, as shown in FIG. 6. A middle second thick portion 28B is arranged at a widthwise middle position in an area between the second recesses 26B. Left and right side second thick portions 29B are arranged at opposite widthwise sides in areas extending from the left and right second recesses 26B to the outer lateral edges of the receiving plate 20. Specifically, the second thin portions 27B are between the middle second thick portion 28B and the side second thick portions 29B. In other words, three second thick portions 28B, 29B and two second thin portions 27B are arranged alternately in the width direction WD.

The lower surfaces of the middle second thick portion 28B and the side second thick portions 29B preferably are flat and substantially parallel to a proper inserting direction of the male tab M into the rectangular tube 10 and can be held continuously in surface contact with the upper surface of the male tab M in the width direction WD and in forward and backward directions FBD. Further, the lower surfaces of the middle second thick portion 28B and the side second thick portions 29B preferably are at the same height. The second facing surface 20S of the receiving plate 20 preferably is substantially symmetrical with respect to the width direction WD. Further, the first and second facing surfaces 15S, 20S preferably are vertically symmetrical with respect to a positional relationship of the first thin portions 27A and the second thin portions 27B.

Figure 8:
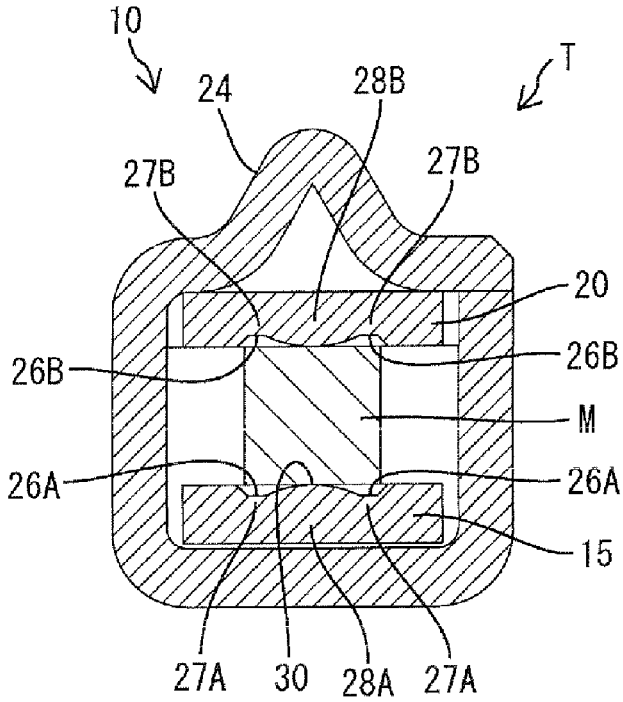
FIG. 8 is a lateral section showing the male tab inserted in the rectangular tube.

A widthwise middle part of the lower surface of a properly inserted male tab M is held in substantially line contact with the main contact point 30 of the middle first thick portion 28A and the opposite sides of the properly inserted male tab M in the width direction WD substantially correspond to the two first thin portions 27A (first recesses 26A), as shown in FIG. 8. In other words, the lower surface of the properly inserted male tab M is in contact with the resilient contact piece 15 only at its widthwise middle part. Thus, a contact area with the resilient contact piece 15 is small as compared with the case where the lower surface of the male tab M is in contact over the entire width.

On the other hand, a widthwise middle of the upper surface of the properly inserted male tab M is held in substantially surface contact with the lower surface of the middle second thick portion 28B and the opposite sides of the male tab M in the width direction WD correspond to the two second thin portions 27B (second recesses 26B). In other words, the upper surface of the properly inserted male tab M contacts only the widthwise middle of the receiving plate 20. Thus, a contact area with the receiving plate 20 is small as compared with the case where the upper surface of the male tab M is in contact over the entire width.

Figure 7:
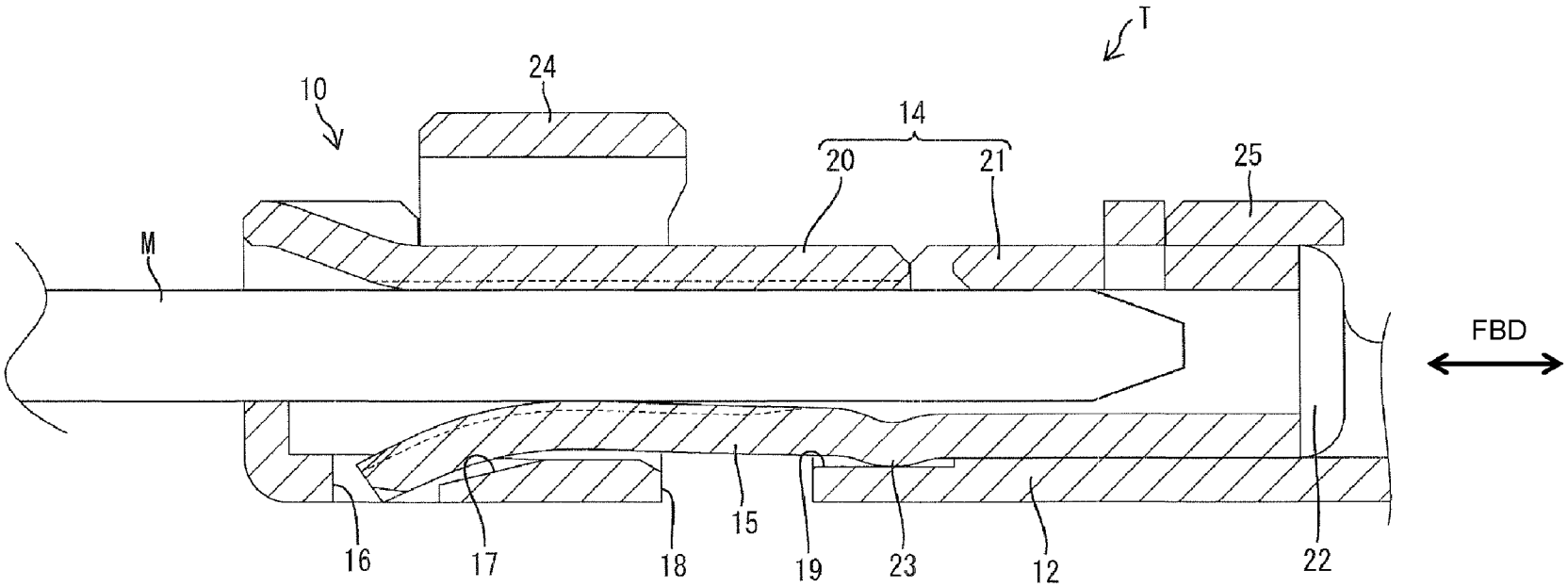
FIG. 7 is a longitudinal section showing a state where a male tab is inserted in a rectangular tube portion.

The resilient contact piece 15 deforms resiliently down and out when the male tab M is inserted into the rectangular tube 10 with the supporting portion 23 at the rear end as a supporting point. At this time, the front end of the resilient contact piece 15 is inserted into the first window 16 and the tapered notch 17, as shown in FIG. 7. Thus, a resiliently deformed amount of the resilient contact piece 15 and a resilient restoring force accumulated in the resilient contact piece 15 need not be excessively large.

Figure 9:
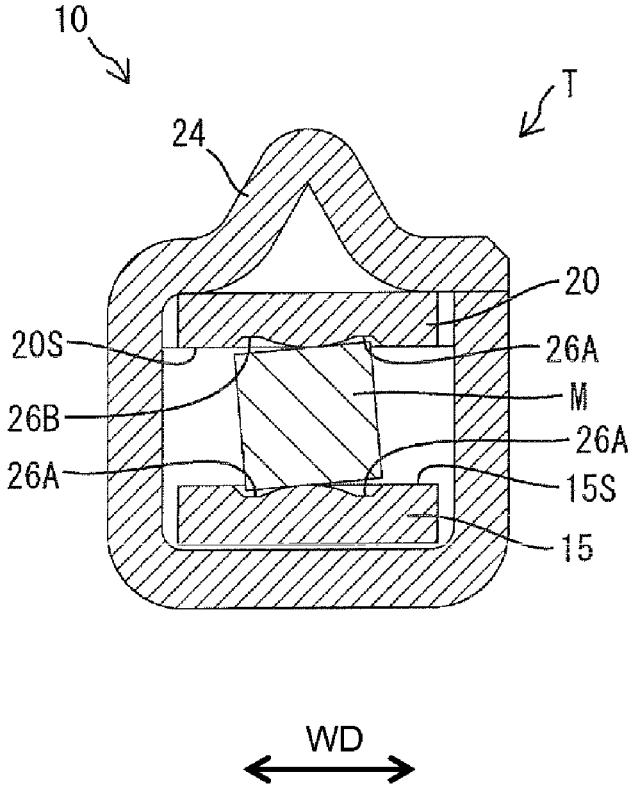
FIG. 9 is a lateral section showing the male tab inclined.

The male tab M could be inserted in the rectangular tube 10 while inclined about an axial line extending in forward and backward directions with respect to the rectangular tube 10, as shown in FIG. 9. Thus, the opposite right and left edges of the male tab M enter the first recess 26A and the second recess 26B, and there is no likelihood that the lateral edges of the male tab M will contact the first facing surface 15S of the resilient contact piece 15 and the second facing surface 20S of the receiving plate 20. Therefore, the male tab M will not damage the first and second facing surfaces 15S, 20S.

Figure 10:
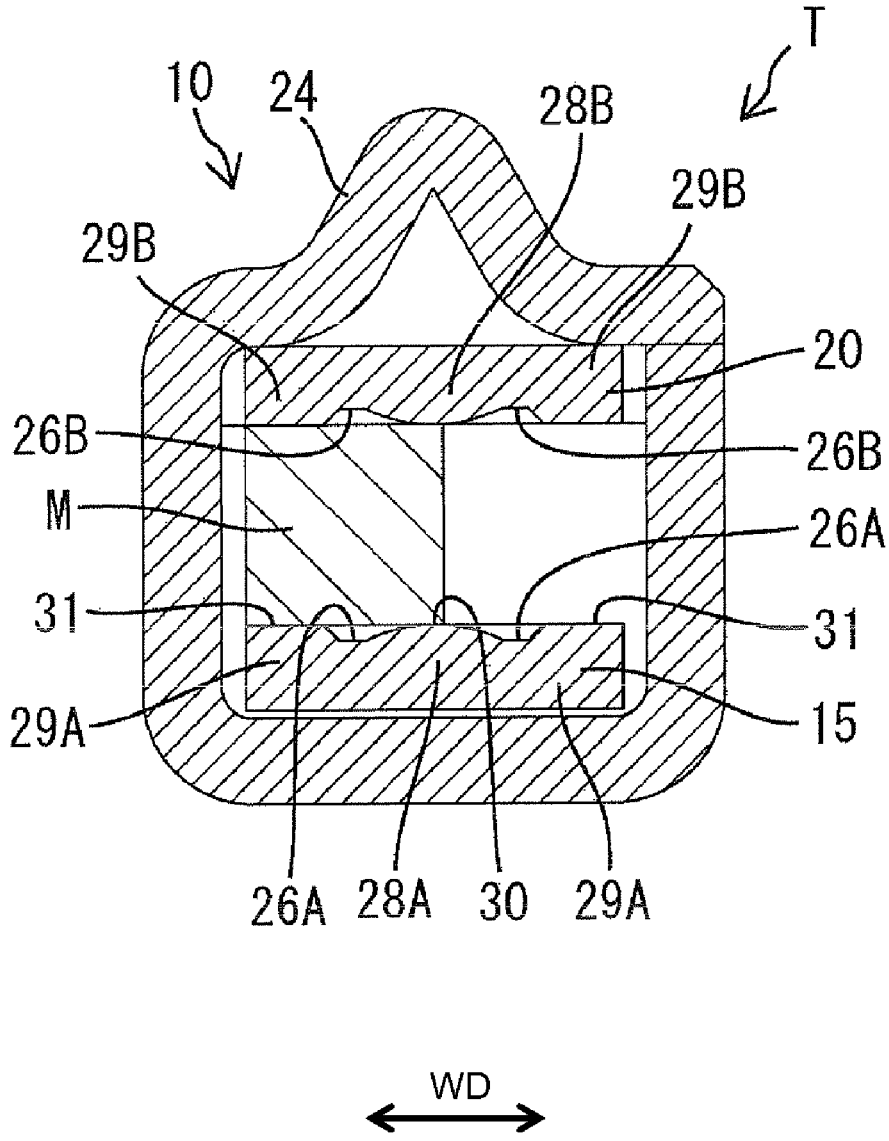
FIG. 10 is a lateral section showing the male tab displaced in a width direction.
Figure 11:
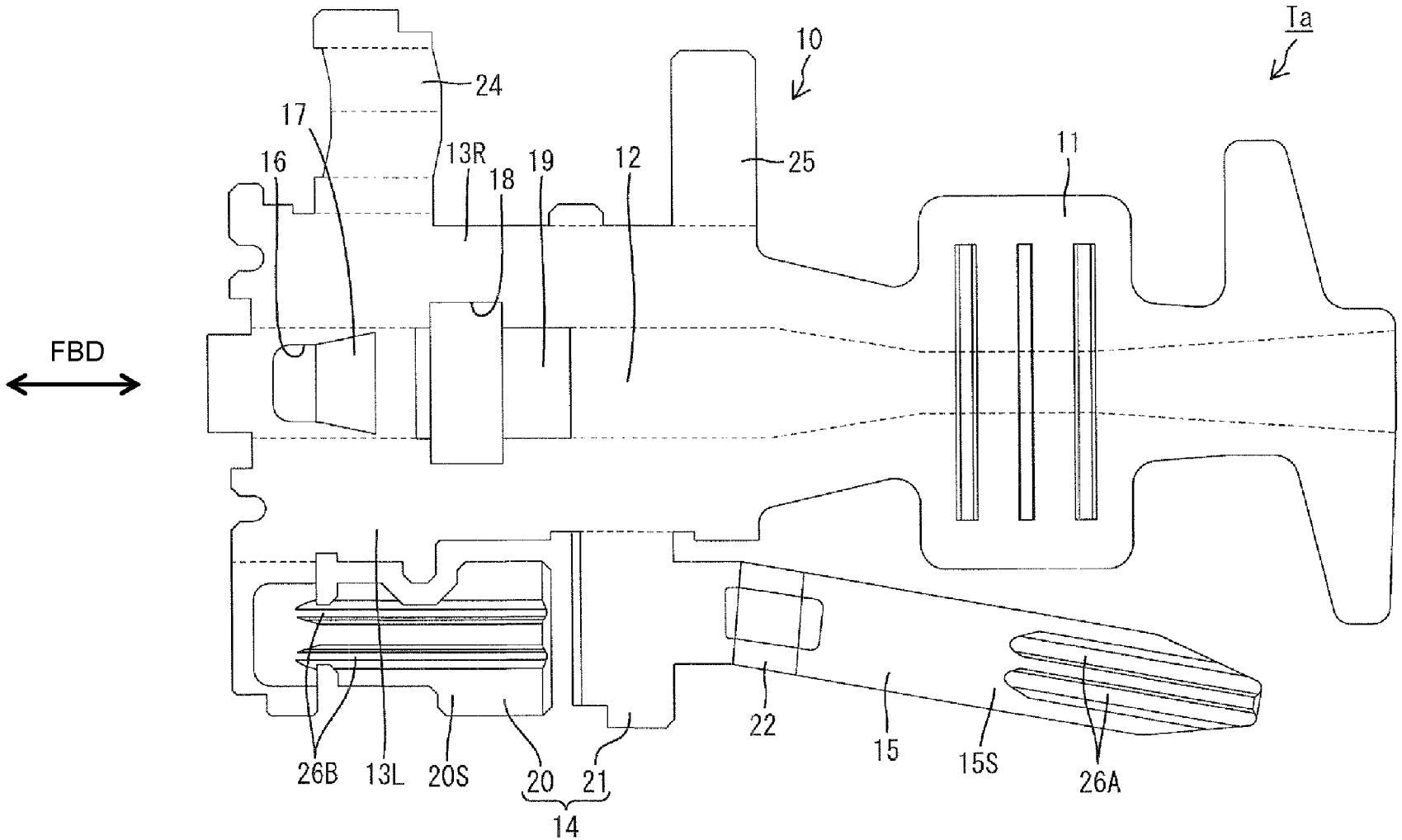
FIG. 11 is a development view of the terminal fitting.

The male tab M inserted to a proper position in the rectangular tube portion 10 may be displaced in the width direction WD or the male tab M may be inserted to a position displaced from the proper position in the width direction WD from the very beginning. In this situation, the contact points 30, 31 of the three first thick portions 28A, 29A of the resilient contact piece 15 are at substantially the same height and the lower surfaces of the three second thick portions 28B, 29B of the receiving plate 20 are at substantially the same height. Accordingly, the laterally displaced male tab M has opposite left and right sides of the lower surface thereof held in contact with the main contact portion 30 of the middle first thick portion 28A and the auxiliary contact points 31 of one of the side first thick portions 29A and also has the widthwise middle of the lower surface thereof correspond to one of the first recesses 26A, as shown in FIG. 10, so as not be in contact with the resilient contact piece 15.

The opposite left and right ends of the upper surface of the male tab M are held in contact with the lower surface of the middle second thick portion 28B and the lower surface of one of the side second thick portions 29B. Additionally, the widthwise middle part of the upper surface of the male tab M corresponds to one of the second recesses 26B so as not to be in contact with the receiving plate 20. In this way, the opposite widthwise ends of the lower and upper surfaces of the male tab M that has been displaced from the proper position in the width direction are held in contact with the resilient contact piece 15 and the receiving plate 20. Thus, a stable contact state is maintained.

As described above, the first facing surface 15S of the resilient contact piece 15 facing the male tab M and the second facing surface 20S of the receiving plate 20 facing the male tab M are recessed (notched or provided with a non-flat surface) within the range of the thickness of the conductive plate material Ta. Accordingly, the thick portions 28A, 29A, 28B and 29B and the thin portions 27A, 27B are arranged alternately in the width direction WD, which is orthogonal to the inserting direction of the male tab M. The male tab M is held partly in contact with the thick portions 28A, 29A, 28B and 29B in the width direction WD. In this way, the resilient contact piece 15 and the receiving plate 20 are held in contact with the male tab M only at the thick portions 28A, 29A, 28B and 29B. Therefore, a contact area is small and contact resistance is low.

The resilient contact piece 15 and the receiving plate 20 are partially notched or recessed within the range of the thickness of the conductive plate material Ta for reducing the contact resistance. Thus, the terminal fitting T (rectangular tube 10) has a shorter height in the vertical direction in which the male tab M is squeezed as compared with the case where a contact point in the form of a projection is formed.

The main contact point 30 of the middle first thick portion 28A arranged in the widthwise intermediate position has a constant height in the width direction WD. Thus, the middle first thick portion 28A and the male tab M are held continuously in line contact in the width direction WD in a contact state of the male tab M with the middle first thick portion 28A. On the other hand, the middle second thick portion 28B arranged in the widthwise intermediate position has a constant height in the width direction. Thus, the middle second thickened portion 28B and the male tab M are held continuously in surface contact in the width direction WD in a contact state of the male tab M with the middle second thick portion 28B. Accordingly, the male tab M is not likely to incline about an axial line extending in forward and backward directions FBD to bring the opposite left and right edges of the male tab M closer to the resilient contact piece 15 and the receiving plate 20. Thus, a stable contact state is maintained.

The invention is not limited to the above described and illustrated embodiment. For example, the following embodiments are also embraced by the technical scope of the present invention as defined by the claims.

The widthwise arrangement of the thick and thin portions on the surfaces facing the male tab is applied to both the resilient contact piece and the receiving plate in the above embodiment. However, this arrangement may be applied only to the resilient contact piece or only to the receiving plate. In the case of applying this mode only to the resilient contact piece, a recess can be formed in the facing surface of the receiving plate facing the male tab by hammering the receiving plate toward the outer side and a projection projecting from the outer surface of the receiving plate by hammering can be arranged in the dead space between the receiving plate and the bulge. This disposition of the projection in the dead space avoids enlargement of the rectangular tube.

The thick portion in the widthwise center and the thick portions at the opposite widthwise sides have the same thickness in the above embodiment. However, the thick portions at the opposite widthwise sides may be thinner than the thick portion in the widthwise center.

Three thick and two thin portions are arranged alternately in the above-described embodiment. However, the numbers of the thick portions and the thin portions are not limited to these. For example, four or more thick portions and three or more thin portions may be arranged alternately or one thin portion may be arranged between two thick portions. In any case, the number of the thick portions is larger or smaller than that of the thin portions by one.

The number of thick portions exceeds the number of thin portions in the above-described embodiment. However, the number of the thin portions may exceed the number of the thick portions. For example, two thin portions may be arranged at opposite sides of one thick portion or two or more thick portions and three or more thin portions may be arranged alternately.

Although the resilient contact piece is laterally symmetrical in the above embodiment, it may be laterally asymmetrical.

Although the receiving plate is laterally symmetrical in the above embodiment, it may be laterally asymmetrical.

Surfaces of the resilient contact piece and the receiving plate that face the male tab need not be vertically symmetrical.

The thick portions in the widthwise centers are held in line contact with the male tab in the width direction in the above embodiment. However, the thick portions in the widthwise centers may be in line contact in forward and backward directions, point contact or surface contact with the male tab.

The thick portions at opposite widthwise sides are in line contact with the male tab in the width direction in the above embodiment. However, the thick portions at the opposite widthwise sides may be in point contact, line contact in forward and backward directions or surface contact with the male tab.

Only the thick portions in the widthwise centers contact the male tab if the male tab is inserted to a correct position in the width direction in the above embodiment. However, the thick portions in the widthwise centers and those at the opposite widthwise sides may be held in contact with the male tab when the male tab is inserted to the correct position in the width direction.

The resilient contact piece is connected with the rear end of the upper plate in the above embodiment. However, the resilient contact piece may be connected with the front end of the bottom plate and folded back.

The resilient contact piece is supported at one end in the above embodiment. However, the opposite front and rear ends of the resilient contact may be connected with a plate of the rectangular tube.

What is claimed is:

1. A terminal fitting formed by bending, folding or embossing a conductive plate material having a specified shape and a specified thickness to define a tube with a receiving plate having a first surface facing into the tube and a second surface opposite the first surface, opposed side plates angularly aligned to the receiving plate and a resilient contact piece at least partly accommodated in the tube and having a first surface facing the first surface of the receiving plate and a second surface facing away from the receiving plate so that a male tab inserted into the tube is squeezed resiliently between the receiving plate of the tube and the resilient contact piece for achieving electrically conductive connection, wherein:

at least one of the first surface of the resilient contact piece and the first surface of the receiving plate having recesses within a range of the specified thickness of the conductive plate material so that the recesses define thin portions less than the specified thickness and so that areas adjacent the recesses define thick portions having the specified thickness, the thick portions and thin portions being alternately arranged in a width direction orthogonal to an inserting direction of the male tab so that the thin portions are spaced inwardly from the side plates and so that parts of the male tab in the width direction can be held in contact with at least one of the thick portions, and wherein the first surface of the resilient contact piece and the first surface of the receiving plate each has at least two recesses spaced apart in the width direction.

2. The terminal fitting of claim 1, wherein the thick portions are arranged in a substantially widthwise intermediate portion and at least at one opposite widthwise sides.

3. The terminal fitting of claim 1, wherein the recesses are arranged to substantially correspond to opposite lateral edges of the male tab when properly inserted in the width direction.

4. The terminal fitting of claim 1, wherein horizontal cross-sectional shapes of the recesses orthogonal to forward and backward directions are accurate.

5. The terminal fitting of claim 1, wherein a main contact point is defined at a first of the thick portions for contacting the male tab and auxiliary contact points are defined at sides of the first thick portions, the main contact point and the auxiliary contact points being substantially aligned in the width direction for achieving substantially continuous line contact with the male tab in the width direction.

6. The terminal fitting of claim 1, wherein a rear end of the resilient contact piece is embossed out to form at least one support held in contact with an inner surface a base plate of the tube for supporting resilient deformation of the resilient contact piece.

7. The terminal fitting of claim 6, wherein the support extends substantially straight in the width direction.

8. The terminal fitting of claim 5, wherein the support has a substantially accurate shape in a cross section normal to the width direction.

9. A terminal fitting of claim 1, formed by bending, folding, or embossing a conductive plate material having a specified shape and a specified thickness to define a tube and a resilient contact piece at least partly accommodated in the tube, so that a male tab inserted into the tube is squeezed resiliently between a receiving plate of the tube and the resilient contact piece for achieving electrical conductive connection, wherein:

a facing surface of the resilient contact piece substantially facing the male tab and a facing surface of the receiving plate substantially facing the male tab each having at least two recesses within a range of the thickness of the conductive plate material to define thick portions and thin portions alternatively arranged in a width direction orthogonal to an inserting direction of the male tab so that parts of the male tab in the width direction can be held in contact with at least one of the thick portions; and wherein the recesses extend in forward and backward directions from a front end of the resilient contact piece to a position in proximity to a supporting portion thereof.

10. A terminal fitting formed from a conductive plate material having a specified thickness, the terminal fitting having opposite front and rear ends spaced apart along a longitudinal direction and defining a width direction transverse to the longitudinal direction, a tube extending along the longitudinal direction, the tube including a receiving plate formed with an inwardly facing receiving plate surface, a resilient contact piece at least partly accommodated in the tube and having a contact piece surface facing the receiving plate surface, at least one recess within a range of the specified thickness of the conductive plate material being formed in at least one of the receiving plate surface and the contact piece surface, the recess extending in the longitudinal direction and defining at least one thin portion having a thickness less than the specified thickness and at least one thick portion having a thickness equal to the specified thickness being substantially adjacent the thin portion, the at least one thin portion and the at least one thick portion extending in the longitudinal direction, wherein the contact piece surface of the resilient contact piece and the receiving plate surface each has two of the recesses defining two of the thin portions and three of the thick portions.

11. The terminal fitting of claim 10, wherein the recesses in the receiving plate substantially register respectively with the recesses in the contact piece.

12. The terminal fitting of claim 10, wherein the receiving plate has a surface opposite the receiving plate surface that is substantially free of recesses extending in the longitudinal direction, and the contact piece as a surface opposite the contact piece surface that is substantially free of recesses.

13. The terminal fitting of claim 10, wherein the surfaces of the thick portions of the receiving plate define a plane aligned substantially parallel to the longitudinal direction and the width direction.

* * * * *